United States Patent [19]

Smith

[11] 4,317,248

[45] Mar. 2, 1982

[54] HAND TOOLS

[75] Inventor: Morley L. Smith, Beaconsfield, Canada

[73] Assignee: T. S. Simms & Co. Limited, Saint John, Canada

[21] Appl. No.: 242,291

[22] Filed: Mar. 10, 1981

Related U.S. Application Data

[63] Continuation of Ser. No. 970,383, Dec. 18, 1978, abandoned.

[51] Int. Cl.[3] ..... A46B 5/02

[52] U.S. Cl. ..... 15/145; 15/146; 15/150; 15/153; 16/114 R

[58] Field of Search ..... 15/145–154, 15/176, 189; 16/114 R

[56] References Cited

U.S. PATENT DOCUMENTS

| | | | |
|---|---|---|---|
| 501,823 | 7/1893 | Caldwell | 15/150 |
| 2,670,250 | 2/1954 | Greene, Jr. | 15/146 |
| 3,037,230 | 6/1962 | Strand et al. | 15/153 |
| 3,362,038 | 1/1968 | Blount | 15/150 |

FOREIGN PATENT DOCUMENTS

| | | | |
|---|---|---|---|
| 526008 | 9/1940 | United Kingdom | 15/153 |
| 901323 | 7/1962 | United Kingdom | 15/145 |

*Primary Examiner*—Philip R. Coe
*Assistant Examiner*—Timothy F. Simone
*Attorney, Agent, or Firm*—Fetherstonhaugh & Co.

[57] ABSTRACT

A hand tool according to the present invention comprises in combination, a workpiece assembly and a handle assembly adapted for quick release coupling to one another to provide a manually supported tool having rapidly interchangeable workpieces. The workpiece assembly includes a work head adapted to function as a painting or decorating tool or the like and a support member on the head. The support member has a section of its length disposed rearwardly from the head which extends in a tortuous path to form a first coupler element. The handle assembly comprises an elongated manually engageable handle and a quick release clamp. The quick release clamp comprises first and second jaws which have a clamping face formed with a channel-shaped clamping recess which extends along a tortuous path corresponding to that followed by the coupler element whereby the coupler element may be seated in the clamping recess in a close fitting relationship. The tortuous path in the clamp and on the support member are arranged in a configuration to prevent relative movement between the head and the handle in use.

2 Claims, 5 Drawing Figures

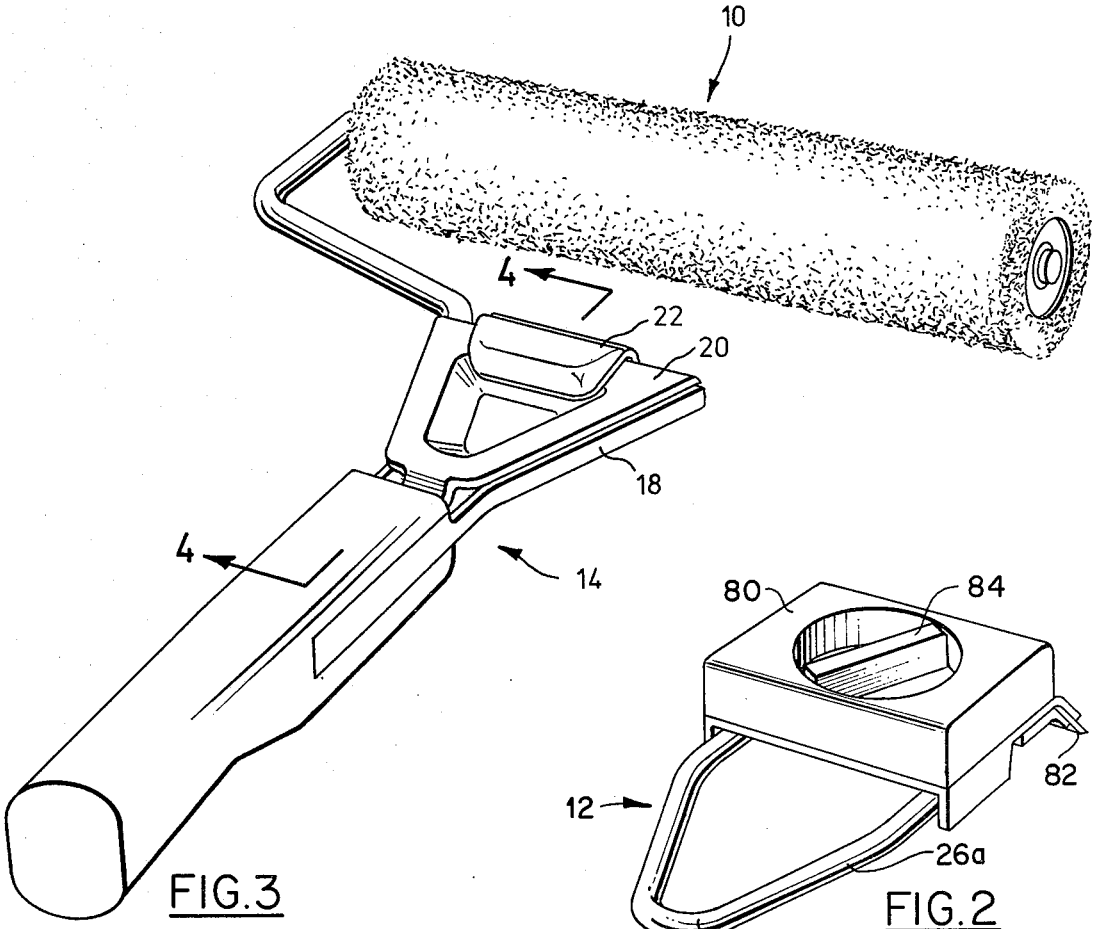
FIG.3
FIG.2
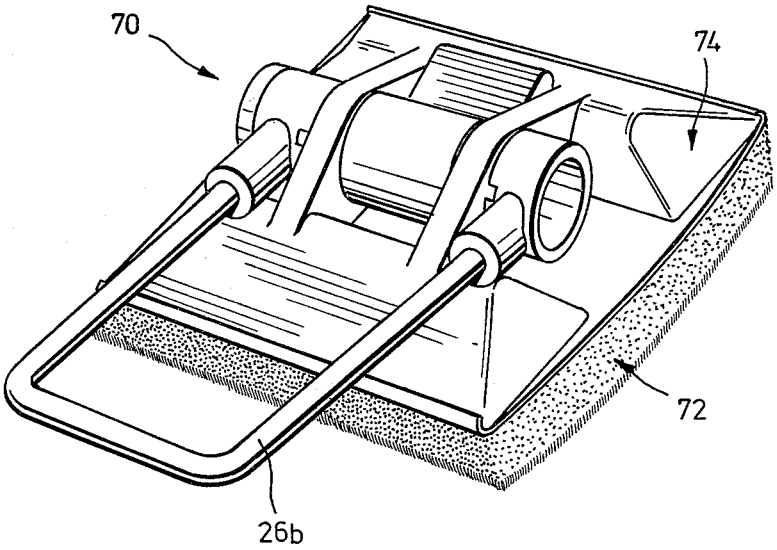
FIG. 5

HAND TOOLS

This is a continuation of application Ser. No. 970,383 filed Dec. 18, 1978, abandoned.

This invention relates to hand tools. In particular, this invention relates to painting or decorating hand tools in which a plurality of work heads may be mounted or released from a single handle.

In many painting or decorating hand tools, it is common to have a work head permanently mounted on a handle. For example, in paint roller coaters and in paint applicator pads the head includes a wire rod which is embedded in a handle and projects forwardly therefrom. In other tools such as paint scrapers, the scraping element is mounted in a head located at one end of a handle. The handle in both instances, and in many other painting and decorating tools, is designed to enable the work head to be manually supported at the work site. It is important that a sufficient load may be transmitted from the handle to the work head in order to ensure that the work head will perform the work which it is designed to perform.

A contributing factor to the cost of a set of painting and decorating tools is in the fact that each tool is provided with its own handle. I have recognized that handles which are required for a wide variety of painting and decorating tools may be of substantially identical construction.

As previously indicated, it is important to ensure that a loading force can be transmitted from the handle of the tool to the work head in a manner which will provide for the efficient use of the work head. In most painting and decorating tools it is important to ensure that the load applied through the handle can be transmitted substantially uniformly across the width of the head as, for example, in a paint roller it is important that a substantially uniform pressure be applied across the paint roller in order to give an even paint distribution. In addition, in a scraping tool it is important to be able to apply a uniform load across the width of the scraping blade or to selectively apply a major portion of the load to one or other selected areas of the scraper blade. Thus, it is important that the connection between the head and the handle be adapted to provide adequate support for the head.

In attempting to provide an improved hand tool, I have developed a quick release clamping mechanism which can be manually operated so that the work head can be mounted on or released from the handle without the aid of any manipulating tools. Thus, the user of the equipment can conveniently remove one work head and replace it with another without requiring any additional tools.

By reason of the fact that the head can be easily separated from the handle, an operator may alternatively substitute one head for the other as required in use. Furthermore, the storage space required to store a kit which included a variety of different tools is greatly reduced.

SUMMARY OF INVENTION

According to one aspect of the present invention, there is provided in combination, a paint or decorating workpiece assembly and a handle assembly adapted for quick release coupling to one another to provide a manually supported tool having a rapidly interchangeable workpiece, said workpiece assembly comprising, a work head adapted to function as a painting or decorating tool, a support member mounted on said work head, said support member having a section of its length disposed rearwardly from said work head which extends in a tortuous path to form a first coupler element, said handle assembly comprising an elongated manually engageable handle having an inner end and an outer end, a quick release clamp comprising first and second jaws having first and second clamping faces respectively, said first jaw being mounted on and projecting outwardly from said outer end of said handle, said second jaw being mounted for movement relative to said first jaw between a clamping position in which the first and second clamping faces are disposed opposite one another in a clamping relationship and a release position in which said first and second clamping faces are spaced from one another to permit release of a first coupler element in use, said first clamping face having a channel shaped clamping recess formed therein, said clamping recess extending inwardly from an edge of said first jaw along a tortuous path corresponding to that followed by said coupler element of said support arm whereby said coupler element of said support arm may be seated in said clamping recess in a close fitting relationship, said tortuous path being arranged in a configuration to prevent relative movement between said first jaw and said first coupler element when said first coupler element is clamped between said first and second jaws and said first and second jaws are in said clamping position, and clamping means for securing said jaws with respect to one another in said clamping position.

According to a further aspect of the present invention, there is provided the combination as described above wherein the support member comprises an elongated support rod which is bent upon itself to a generally V-shaped configuration, the apex of the V-shaped configuration being directed toward the outer end of the handle whereby movement of the workpiece assembly toward and away from the handle serves to wedge the first coupler element in the clamping channel.

The invention will be more clearly understood after reference to the following detailed specification read in conjunction with the drawings, wherein FIG. 1 is an exploded view of a workpiece assembly in the form of a paint roller constructed in accordance with an embodiment of the present invention;

FIG. 2 is a pictorial view of a workpiece assembly in the form of a scraper which is interchangeable with the roller workpiece assembly of FIG. 1;

FIG. 3 is a pictorial view of the workpiece assembly of FIG. 1 in an assembled configuration;

FIG. 5 is a pictorial view of a paint pad adapter suitable for use in combination with an alternative form of clamping mechanism.

Figure 1:
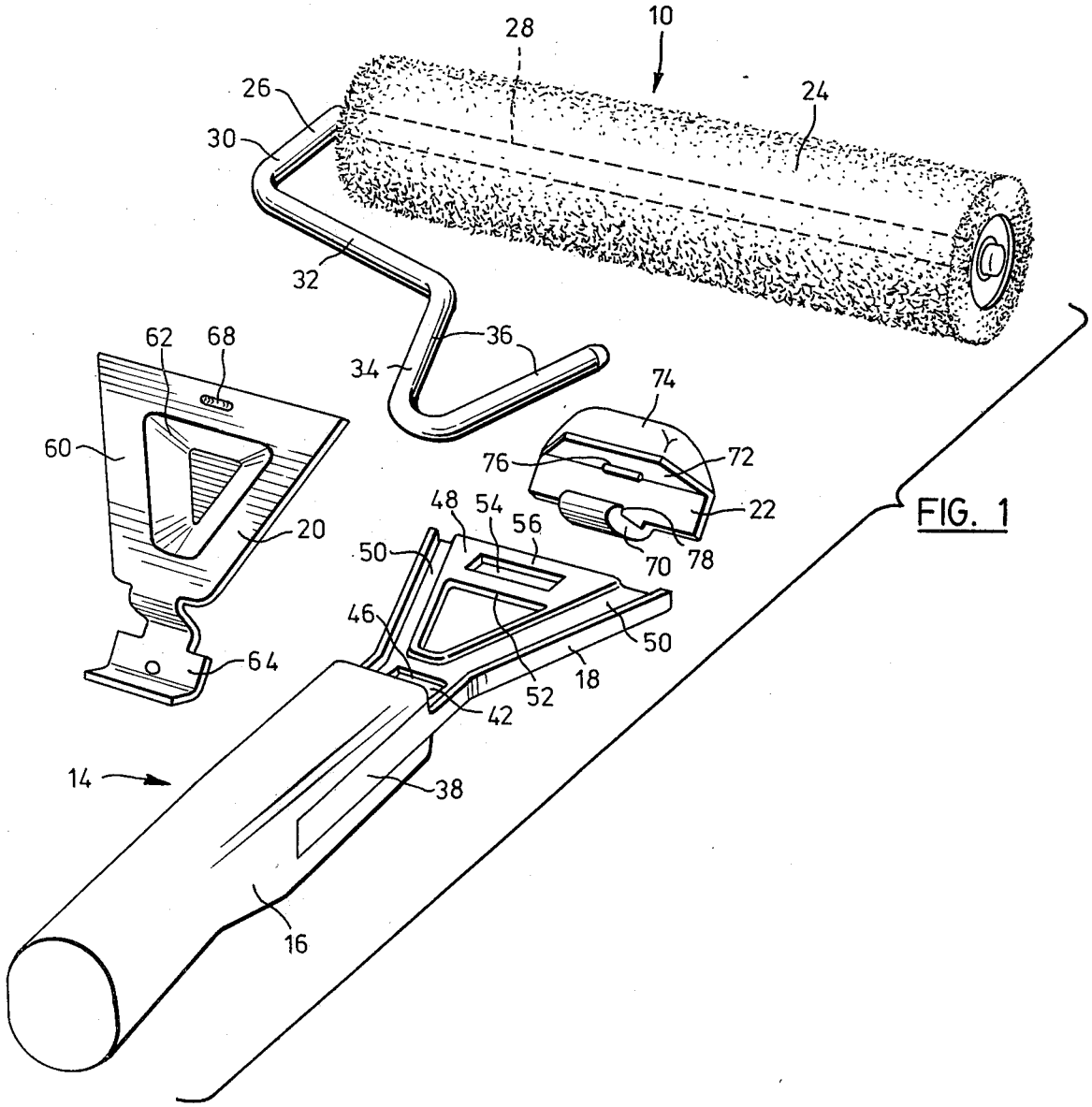

With reference to FIGS. 1 and 3 of the drawings, the reference numeral 10 refers generally to a workpiece assembly adapted to function as a paint roller and in FIG. 2, the reference numeral 12 refers generally to a workpiece assembly suitable for use as a paint scraper. The workpiece assemblies 10 and 12 of FIGS. 1 and 2 respectively are workpiece assemblies, either one of which may be releasably secured to the handle assembly, generally identified by the reference numeral 14 in FIGS. 1 and 3 of the drawings.

It will be understood that while in the preferred embodiments of the present invention described with reference to the drawings the workpiece assemblies which are illustrated are the paint roller workpiece assembly 10 and the scraper workpiece assembly 12, any one of a number of other painting and decorating workpieces may be adapted to be releasably connected to the handle assembly 14 by providing the appropriate support member, as will be described hereinafter.

With reference to FIG. 1 of the drawings, the reference numeral 16 refers generally to a manually engageable support handle which has a first jaw member 18 projecting from one end thereof. A second jaw 20 is provided which, as will be described hereinafter, is adapted to be located in a face-to-face relationship with the first jaw 18 and is releasably retained in a clamping relationship by means of a quick release catch 22.

The workpiece assembly 10 consists of a conventional paint roller 24 which is mounted on a support member 26. The support member 26 is in the form of a metal rod which is bent upon itself to provide a support shaft portion 28 on which the roller 24 is mounted for rotation about its longitudinal axis, a first rearwardly projecting portion 30 which extends rearwardly from one end of the shaft 28, a second rearwardly extending portion 32 which is inwardly inclined to a V-shaped inner portion 34 which is located substantially centrally of the width of the shaft portion 28. The V-shaped inner end portion 34 has legs 36 which extend in a plane parallel to the shaft 28 and diverge in a direction toward the paint roller 24 so as to provide a wide support for resisting torque loads applied about the longitudinal axis of the handle.

Figure 4:
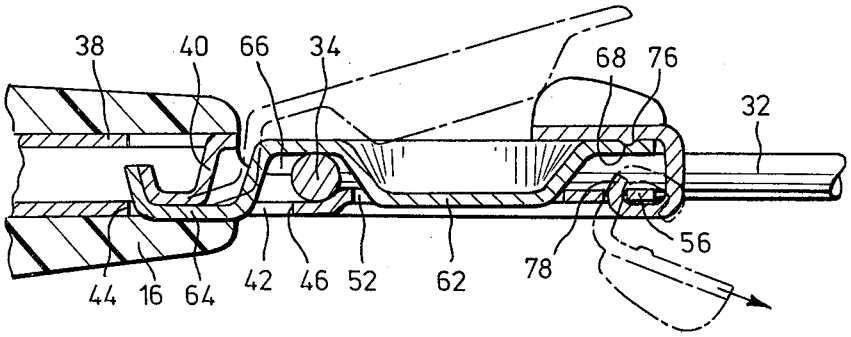
FIG. 4 is a sectional view along the line 4—4 of FIG. 3.

As shown in FIGS. 1, 3 and 4 of the drawings, the first jaw 18 has a hollow shaft portion 38 embedded in the handle 16. One wall of the shaft 38 has a U-shaped lug 40 projecting downwardly therefrom. A passage 42 is located in the opposite wall of the shaft 38 and extends from an inner edge 44 to an outer edge 46, the outer edge 46 being spaced outwardly from the handle 16.

The first jaw 18 has a first clamping face 48 in which a pair of channel-shaped clamping recesses 50 extend in a V configuration diverging toward the handle 16. The channels 50 extend in a tortuous V-shaped path corresponding to the tortuous V-shaped configuration of the inner end 34 of the support member 26 so that the inner end portion 34 may be located in the channel-shaped recesses 50 of the first jaw and secured therein by means of the second jaw 20 and quick release clamp 22, as will be described hereinafter.

The V-shaped configuration of the inner end portion 34 and channel-shaped recesses 50 is a particularly suitable tortuous path configuration in that a load applied axially of the handle serves to increase the wedging load applied by the jaw 50 to the V-shaped inner end portion 34 of the support member. Similarly the V-shaped configuration serves to permit torque to be transmitted from the handle to the workpiece assembly.

The first jaw 18 also has a triangular shaped aperture 52 formed therein. The aperture 52 serves as a centering aperture for aligning the second jaw 20, as will be described hereinafter. A rectangular shaped passage 54 is also formed in the first jaw 18 and serves to provide a transverse rail 56 at the outer end of the jaw 18 which acts as a pivot for the clamp 22, as will be described hereinafter.

The second jaw 20 is in the form of a generally triangular flat plate 60 which has a triangular shaped centering protrusion 62 located centrally thereof which is tapered and proportioned to fit within the aperture 52 to center the second jaw above the first jaw 18. The second jaw 60 also has a generally U-shaped mounting arm 64 at one end thereof which is proportioned to extend through the passage 42 to underlie the U-shaped mounting lug 40. The second jaw 60 has a second clamping face 66 which is arranged in a V-shaped configuration and overlies the channels 50 to clamp the inner end 34 of the support rod 26 within the channel 50. The second jaw 60 also has a shallow recess 68 extending along the outer face thereof adjacent the outer edge thereof.

The clamp member 22 consists of a generally U-shaped body which has oppositely disposed legs 70 and 72 with an enlarged head portion 74 located on the outer face of the leg 72. A small latching detent 76 is located on the inner face of the leg 72 and is insertable in the recess 68 of the second jaw 60 as will be described hereinafter. The first leg 70 has a hook portion 78 at the inner end thereof. The second leg 72 is insertable in the passage 54 of the first jaw 18 with the hook portion 78 extending around and pivoting on the rail 56 so that the clamp member 22 may be pivoted from the release position shown in broken lines in FIG. 4 to the clamp position shown in solid lines in FIG. 4 and shown in FIG. 3.

As shown in FIG. 2 of the drawings, the workpiece assembly may be in the form of a scraper work head 80 which has a scraper blade 82 releasably secured thereto by a clamping device 84. The work head 80 is supported by a support member **26*a* which is again in the form of a metal rod bent upon itself to provide a V-shaped inner portion 34*a***. In this instance, both ends of the V-shaped configuration are connected to the work head.

In use, the operator may have one handle assembly and several workpiece assemblies. It will be understood that in addition to the paint roller assembly and scraper assemblies described in FIGS. 1 and 2 of the drawings, the workpiece assembly may be in the form of a sanding head, a paint applicator pad or the like, each of which is provided with a support member which includes a coupler element extending in a tortuous path, each coupler element being releasably connectible to the head assembly. The coupler elements of the support members of the embodiments illustrated in FIGS. 1 and 2 of the drawings are the V-shaped inner ends 34 and **34*a*** of the respective work heads.

In use, the second jaw 60 is mounted on the first jaw and located in the release position shown in broken lines in FIG. 4 of the drawings whereupon the coupler element 34 or **34*a* of either head may be located in the channel 50. The second jaw 60 is then pivoted to the clamping position shown in solid lines in FIG. 4 and the clamp 22 is pivoted from the release position shown in broken lines in FIG. 4 to the clamping position shown in solid lines in FIG. 4. Thus, it will be seen that a workpiece assembly may be quickly and easily mounted on the head assembly. To release the workpiece assembly, it is merely necessary to engage the clamp member 22 and push it in a direction away from the handle which causes it to pivot about the bar 56 to the release position shown in broken lines in FIG. 4. The second jaw 60 may then be pivoted upwardly to the position shown in broken lines in FIG. 2 to permit withdrawal of the support member 34 for replacement by the support member 34a** or a similar support member of a second workpiece assembly.

Various modifications of the present invention will be apparent to those skilled in the art without departing from the scope of the invention. As previously indicated, the work head may have many forms other than the roller coater and scraper previously described. The work head may, for example, be in the form of a sanding block, a window washer, a window wiper blade, a cleaning sponge, a sponge mop or the like. In addition, the handle may be adapted to receive a handle extension. A modified support member for the work head is illustrated in association with a paint pad work head in FIG. 5. As shown in FIG. 5, the work head assembly 70 includes a removable paint applicator pad 72, a releasable clamping mechanism 74 and a support member 26b. The support member 26b has a generally U-shaped configuration which may be used in conjunction with a similarly shaped clamping device. While the U-shaped configuration of the support member 26b provides an adequately tortuous path to ensure that the work head may be secured with respect to the handle, it will be apparent that the wedge effect of the V-shaped configuration of the support members 26 and 26a provide a superior connection.

It will be apparent from the foregoing that while the V-shaped configuration of the tortuous path followed by the coupler elements of the preferred embodiment has numerous advantages in that it is very easy to form a support member in the form of a rod to this configuration, alternative tortuous paths are possible. For example, the rod may be bent upon itself to a generally U-shaped configuration or a triangular or rectangular configuration. The configuration is arranged to prevent relative movement occurring between the cooperating elements of the coupler.

What I claim as my invention is:

1. In combination, a paint or a decorating workpiece assembly and a handle assembly adapted for quick release coupling to one another to provide a manually supported tool having a rapidly interchangeable workpiece, said workpiece assembly comprising;

(a) a work head adapted to function as a painting or decorating tool, (b) a support member mounted on said work head, said support member having a section of its length disposed rearwardly from said work head which extends in a tortuous path to form a first coupler element, said handle assembly comprising, (i) an elongated manually engageable handle having an inner end and an outer end, (ii) a quick release clamp assembly comprising first and second jaw members, said first jaw member having a first face which extends outwardly from the outer end of said handle toward said work head in a first plane, a channel-shaped recess formed in said first face of said first jaw member and extending to a substantial depth below said first plane, said recess having a mounting passage opening longitudinally thereof in said first plane, said recess extending along said first jaw in a tortuous path, the configuration of which is such that the walls of the recess restrict relative movement between said first coupler element and said first jaw to movement into and out of said recess through said mounting passage in a first direction substantially perpendicular to said first plane, at least one end of said recess opening outwardly from said first jaw member at one edge of said first jaw member through which said support member extends to communicate between said first coupler element and said work head, said second jaw member having a second clamping face, said second jaw member being adapted to cooperate with said first jaw member for movement relative to said second jaw member between the clamping position in which said second clamping face overlies and closes said mounting passage of said channel-shaped recess to retain said first coupler element against movement in said first direction and a second position in which said clamping face is spaced from said second jaw to permit mounting and removal of said coupler element through said mounting passage, (iii) means for securing said jaws with respect to one another in said clamping position comprising a U-shaped body having first and second oppositely disposed legs spaced from one another by a clamping channel, said first leg being adapted to pivot on the outer edge of one of said jaws from a first position in which the second leg overlies and engages the outer end of the other jaw and secures the outer end of said jaws within said clamping channel to retain said jaws in said clamping position, said body being pivotable about its pivotal connection to move said second leg away from said first position to a position spaced from said other jaw to release said jaws for movement to said release position.

2. A paint roller frame comprising:

(a) a unitary frame member comprising a metal rod which is bent upon itself to form an elongated shaft portion at one end for receiving a paint roller, a spacer portion projecting rearwardly and inwardly from one end of the shaft portion to a coupler portion which is located centrally of the length of the shaft portion, the coupler portion extending continuously from the other end of the spacer portion along a V-shaped path the apex of which is directed away from the shaft portion such that the arms of the V-shaped coupler portion diverge in a direction toward the shaft portion one on either side of the plane extending through the centre of the length of the shaft portion, the V-shaped coupler having a free end spaced from the free end of the support shaft portion to provide sufficient clearance to permit a paint roller to be mounted on the shaft portion over the free end thereof, (b) an elongated manually engageable handle having an inner end and an outer end, (c) a quick release clamp assembly comprising first and second jaw members, said first jaw member having a first face which extends outwardly from the outer end of said handle toward said work head in a first plane, a channel-shaped recess formed in said first face of said first jaw member and extending to a substantial depth below said first plane, said recess having a mounting passage opening longitudinally thereof in said first plane, said recess having opposed side walls extending in a spaced parallel relationship along said first jaw in a V-shaped path, portions of said channel extending from opposite ends of the apex of the V-shaped path and opening at the outer end of the first jaw to provide support for each of the support portions of the coupler element, the opposed side walls of the recess being arranged and proportioned to restrict relative movement between said first coupler portion and said first jaw to movement into and out of said recess through said mounting passage in a first direction substantially perpendicular to said first plane, said second jaw member having a second clamping face, said second jaw member being adapted to cooperate with said first jaw member for movement relative to said second jaw member between the clamping position in which said second clamping face overlies and closes said mounting passage of said channel-shaped recess to retain said first coupler element against movement in said first direction and a second position in which said clamping face is spaced from said second jaw to permit mounting and removal of said coupler element through said mounting passage.

* * * * *